US010422067B2

(12) United States Patent
Leibman et al.

(10) Patent No.: US 10,422,067 B2
(45) Date of Patent: Sep. 24, 2019

(54) WASHING MACHINE APPLIANCES WITH A PRETREAT COVER

(71) Applicant: Haier US Appliance Solutions, Inc., Wilmington, DE (US)

(72) Inventors: Alexander B. Leibman, Prospect, KY (US); Lucius Levon Cole, Louisville, KY (US); James Quentin Pollett, Louisville, KY (US); Manidhar Vvs Yandamuri, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 185 days.

(21) Appl. No.: 15/459,075

(22) Filed: Mar. 15, 2017

(65) Prior Publication Data

US 2018/0266032 A1 Sep. 20, 2018

(51) Int. Cl.

| | |
|---|---|
| ***D06F 37/26*** | (2006.01) |
| ***D06F 37/12*** | (2006.01) |
| ***D06F 39/14*** | (2006.01) |
| ***D06F 31/00*** | (2006.01) |
| *D06F 39/12* | (2006.01) |
| *D06F 1/00* | (2006.01) |
| *D06F 23/04* | (2006.01) |
| *D06F 29/00* | (2006.01) |

(52) U.S. Cl.

CPC ..... *D06F 37/267* (2013.01); *D06F 31/00* (2013.01); *D06F 37/12* (2013.01); *D06F 39/14* (2013.01); *D06F 1/00* (2013.01); *D06F 23/04* (2013.01); *D06F 29/00* (2013.01); *D06F 39/12* (2013.01)

(58) Field of Classification Search

None

See application file for complete search history.

(56) References Cited

U.S. PATENT DOCUMENTS

| | | | | |
|---|---|---|---|---|
| 4,510,776 | A * | 4/1985 | McNally | D06F 37/28 312/139.2 |
| 4,531,387 | A * | 7/1985 | Cotton | D06F 29/00 312/139.2 |
| 9,187,855 | B2 * | 11/2015 | Gilboe | D06F 29/00 |
| 9,340,915 | B2 | 5/2016 | Kim et al. | |
| 2010/0043987 | A1 * | 2/2010 | Hicks | E06B 9/54 160/378 |
| 2014/0368098 | A1 * | 12/2014 | Emery | D06F 39/12 312/228 |

FOREIGN PATENT DOCUMENTS

| | | |
|---|---|---|
| CN | 2073432 U | 3/1991 |
| CN | 204919104 U | 12/2015 |

OTHER PUBLICATIONS

CN204919104 espacenet translation, Gong Yinqi, Take washing machine of hand washing function, 2015 (Year: 2015).*

* cited by examiner

*Primary Examiner* — Jason Y Ko
*Assistant Examiner* — Cristi J Tate-Sims
(74) *Attorney, Agent, or Firm* — Dority & Manning, P.A.

(57) ABSTRACT

A pretreat cover for a washing machine appliance is movable between a stowed position and a deployed position. In the stowed position, the pretreat cover is spaced apart from an opening defined by a top panel of the washing machine appliance. In contrast, the pretreat cover is at least partially disposed in the opening when the pretreat cover is in the deployed position.

7 Claims, 18 Drawing Sheets

WASHING MACHINE APPLIANCES WITH A PRETREAT COVER

FIELD OF THE INVENTION

The present subject matter relates generally to washing machine appliances and more particularly to washing machine appliances having a pretreat cover.

BACKGROUND OF THE INVENTION

Washing machine appliances generally include a tub for containing water or wash liquid, e.g., water and detergent, bleach, and/or other wash additives. A basket is rotatably mounted within the tub and defines a wash chamber for receipt of articles for washing. During normal operation of such washing machine appliances, the wash liquid is directed into the tub and onto articles within the wash chamber of the basket. The basket or an agitation element can rotate at various speeds to agitate articles within the wash chamber, to wring wash fluid from articles within the wash chamber, etc.

One issue with many conventional washing machine appliances is that consumers have no place to pretreat articles before washing. In many conventional washing machine appliances, there is not an adequate surface or component on which to perform pretreat activities. Accordingly, such activities must be performed in a separate utility sink, a kitchen sink, or in another suitable location using apparatus separate from the washing machine appliance. This can be inconvenient and time-consuming for the consumer.

Accordingly, improved apparatus for allowing convenient pre-treatment options in association with washing machine appliances are desired.

BRIEF DESCRIPTION OF THE INVENTION

Aspects and advantages of the invention will be set forth in part in the following description, or may be apparent from the description, or may be learned through practice of the invention.

A washing machine appliance is provided. The washing machine appliance defines vertical, lateral, and transverse directions, and may include a cabinet comprising a top panel that defines an opening. A tub may be positioned within the cabinet, and a wash basket may be rotatably mounted within the tub. Further, the wash basket may define a wash chamber for receiving articles for washing. A door of the washing machine appliance may be rotatably mounted to the top panel to permit selective access to the opening, and the door may be rotatable between an open position and a closed position. The washing machine appliance may also include a pretreat cover that is movable between a stowed position and a deployed position. In one embodiment, the pretreat cover may be a board that is rotatable between the deployed and stowed positions. In another embodiment, the pretreat cover may be a flexible screen that is movable between the deployed and stowed positions. The pretreat cover may be spaced apart from the opening when in the stowed position. In contrast, the pretreat cover may be at least partially disposed in the opening when in the deployed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
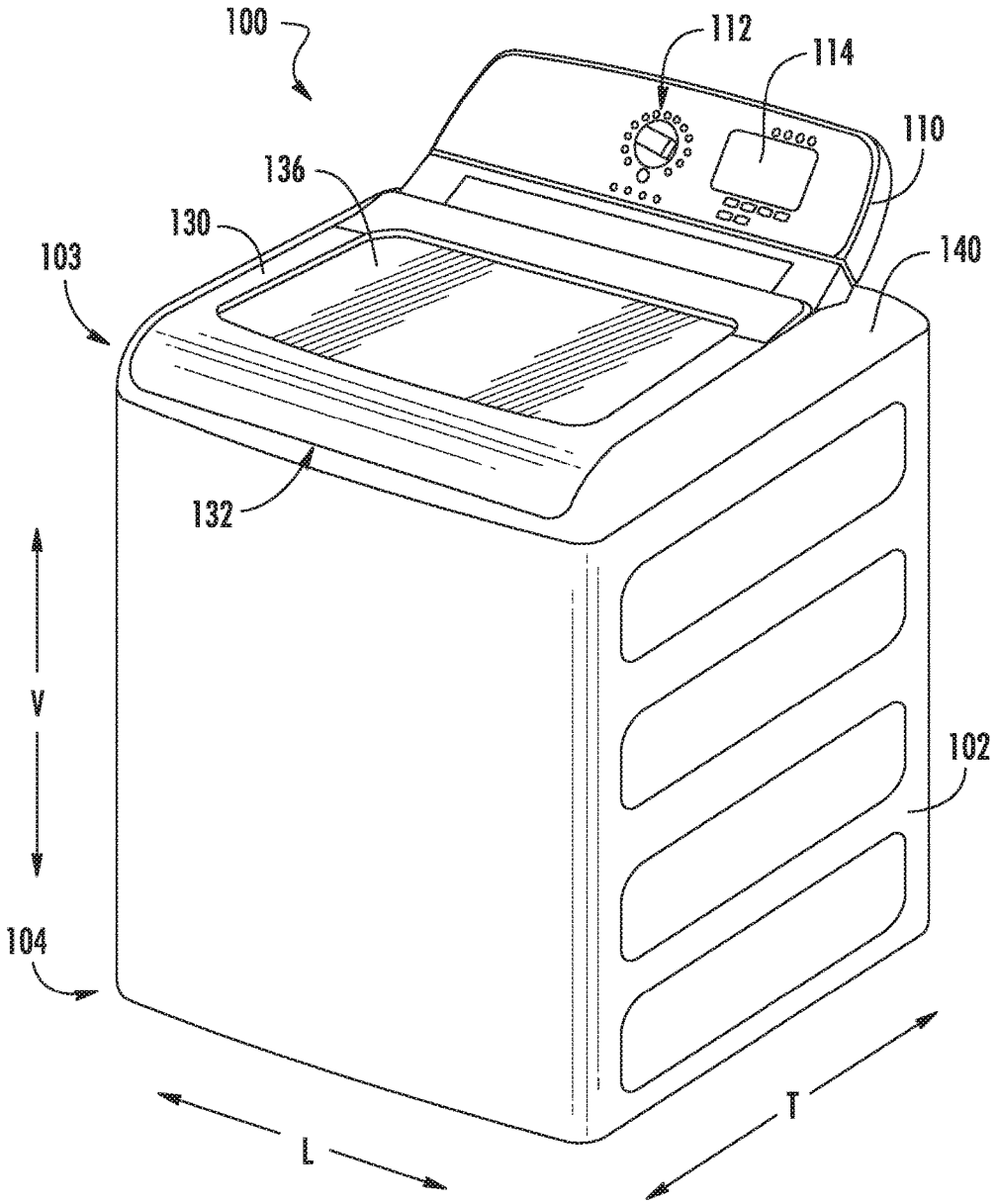
FIG. 1 provides a perspective view of a washing machine appliance according to embodiments of the present subject matter with a door of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
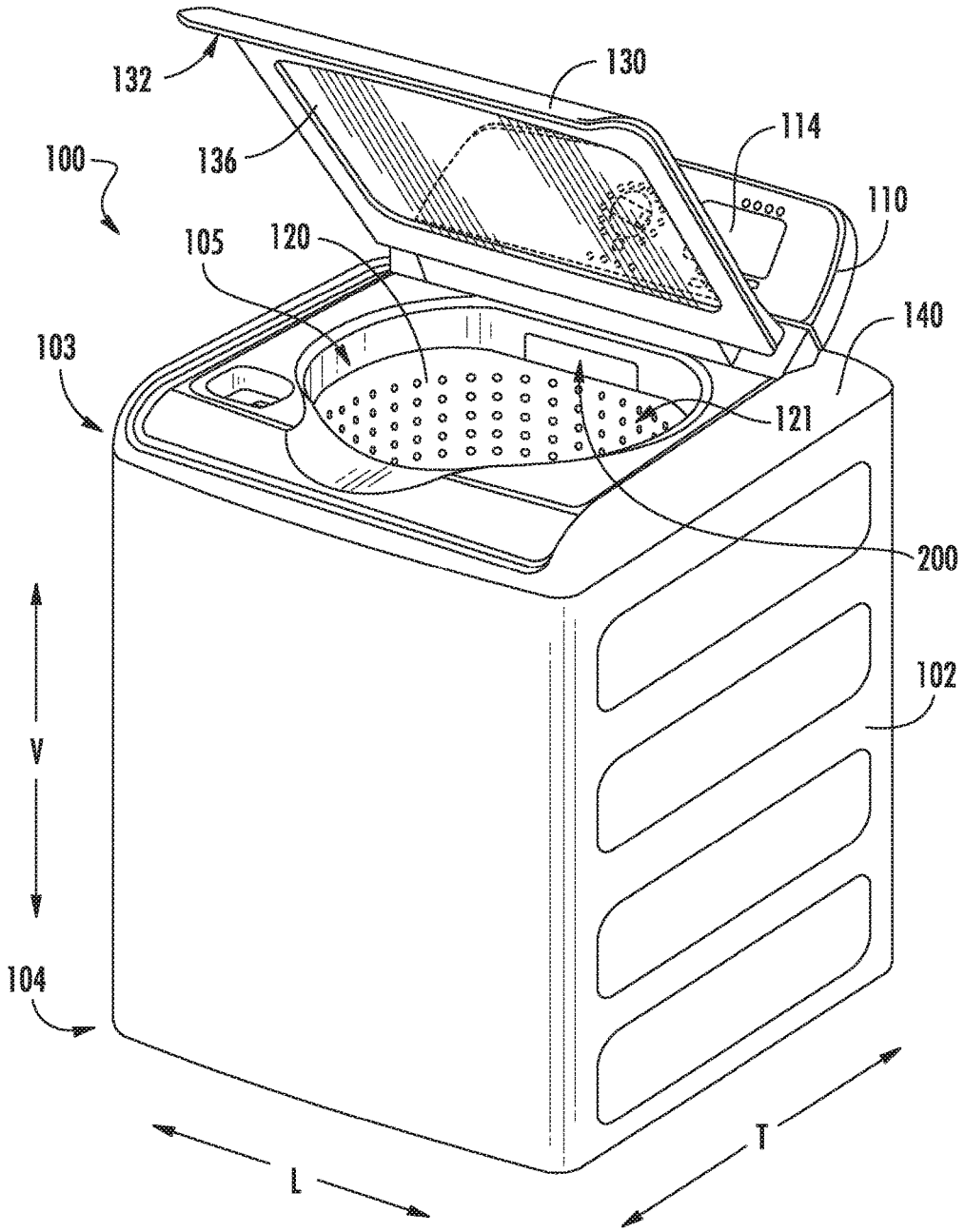
FIG. 2 provides a perspective view of the washing machine appliance of FIG. 1 with the door shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top portion 103 and a bottom portion 104 along the vertical direction V. A wash basket 120 (FIG. 2) is rotatably mounted within cabinet 102. A motor (not shown) is in mechanical communication with wash basket 120 to selectively rotate wash basket 120 (e.g., during an agitation or a rinse cycle of washing machine appliance 100). Wash basket 120 is received within a wash tub or wash chamber 121 (FIG. 2) and is configured for receipt of articles for washing. The wash tub 121 holds wash and rinse fluids for agitation in wash basket 120 within wash tub 121. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140. Top panel 140 defines an opening 105 (FIG. 2) that permits user access to wash basket 120 of wash tub 121. Door 130, rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 (FIG. 1) that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are loaded into wash basket 120 through opening 105, and washing operation is initiated through operator manipulation of input selectors 112. Wash basket 120 is filled with water and detergent and/or other fluid additives via additive dispenser 200, which will be described in detail below. One or more valves can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through opening 105.

Figure 3:
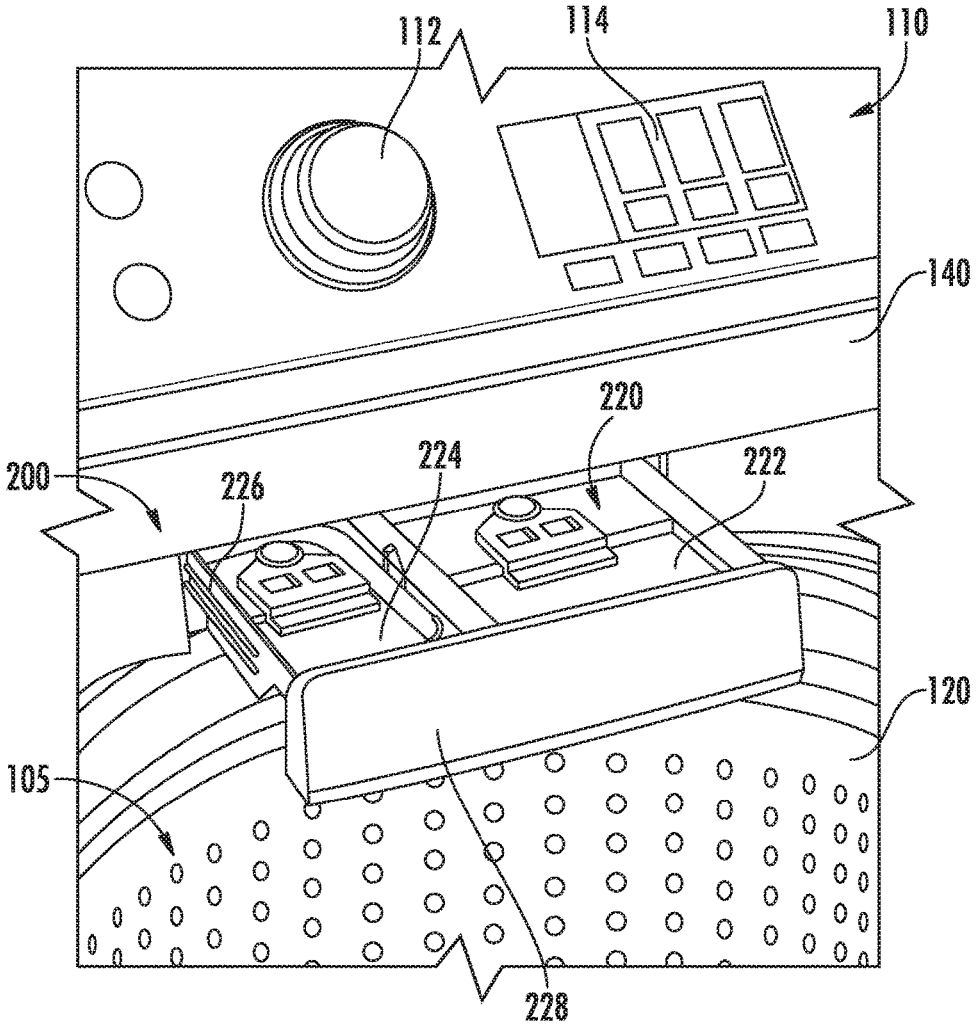
FIG. 3 provides a front, perspective view of an additive dispenser installed in a washing machine appliance according to embodiments of the present subject matter.
Figure 4:
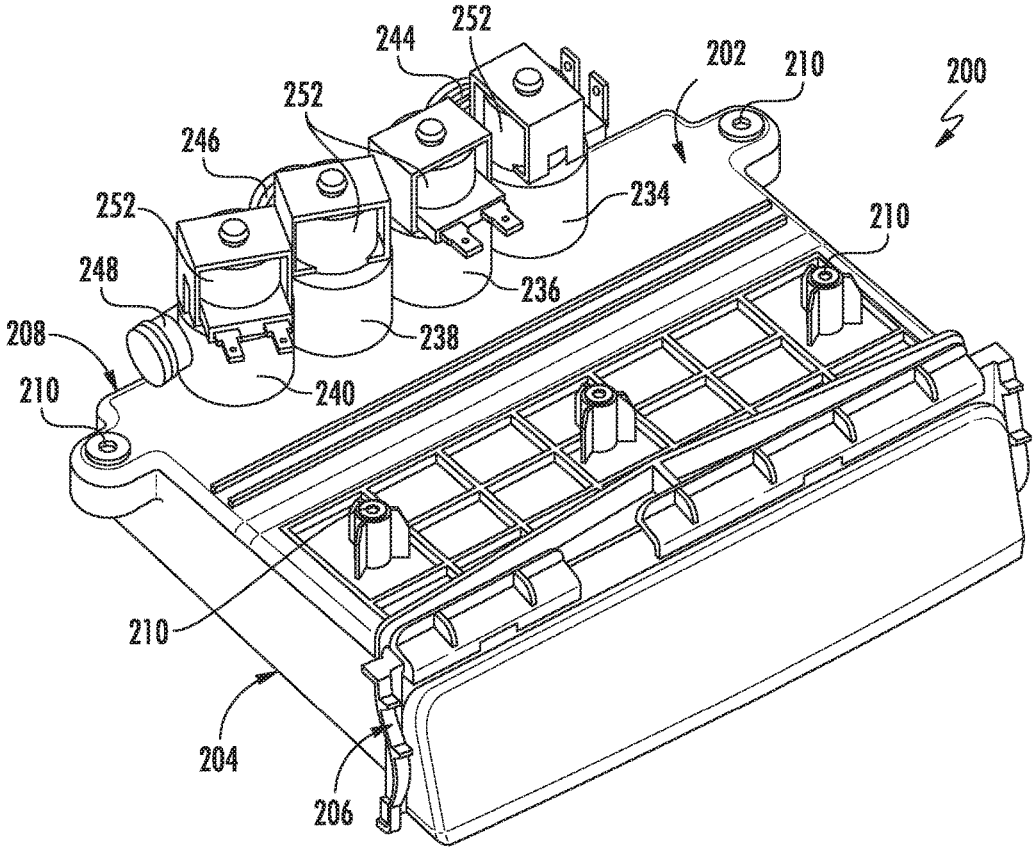
FIG. 4 provides a front, perspective view of the additive dispenser of FIG. 3.

Referring now generally to FIGS. 2 through 4, additive dispenser 200 will be described in more detail. Although the discussion below refers to additive dispenser 200, one skilled in the art will appreciate that the features and configurations described may be used for other additive dispensers in other washing machine appliances as well. For example, additive dispenser 200 may be positioned on a front of cabinet 102, may have a different shape or chamber configuration, and may dispense water, detergent, or other additives. Other variations and modifications of the exemplary embodiment described below are possible, and such variations are contemplated as within the scope of the present subject matter.

Additive dispenser 200 is a box having a substantially rectangular cross-section that defines a top 202 and a bottom 204 spaced apart along the vertical direction V. Additive dispenser 200 also defines a front side 206 and a back side 208 spaced apart along the transverse direction T. As best shown in FIGS. 2 and 3, additive dispenser 200 may be mounted underneath top panel 140 of cabinet 102 such that front side 206 is visible inside opening 105. More specifically, additive dispenser 200 may be mounted to top panel 140 using a plurality of mounting features 210, which may, for example, be configured to receive mechanical fasteners. One skilled in the art will appreciate that additive dispenser 200 may be mounted in other locations and use other mounting means according to alternative exemplary embodiments.

Additive dispenser 200 may define a mixing chamber 220 configured to receive one or more additive compartments. For example, according to the illustrated embodiment, mixing chamber 220 may be configured to slidably receive a detergent compartment 222 and a softener compartment 224. Compartments 222, 224 are slidably connected to the mixing chamber 220 using slides 226 and are connected to a front panel 228 of additive dispenser. In this manner, a user may pull on front panel 228 to slide compartments 222, 224 along the transverse direction T. Once extended, detergent compartment 222 and softener compartment 224 may be conveniently filled with detergent and softener, respectively. Front panel 228 may be then be pushed back into mixing chamber 220 before a wash cycle begins.

Although the illustrated embodiment shows detergent compartment 222 and softener compartment 224 slidably received in mixing chamber 220 for receiving wash additives, one skilled in the art will appreciate that different configurations are possible in alternative exemplary embodiments. For example, more compartments may be used and the compartments may be accessed by a lid instead of sliding out of mixing chamber 220. Alternatively, mixing chamber 220 may draw wash additives from a separate storage container such that sliding compartments 222, 224 are not needed. Other configurations of mixing chamber 220 and compartments 222, 224 are also possible and within the scope of the present subject matter.

Additive dispenser 200 may further include a plurality of valves configured to supply hot and cold water to mixing chamber 220 or directly to wash tub 121. For example, according to the illustrated embodiment, a plurality of apertures may be defined on top 202 of mixing chamber 220 for receiving water. Each aperture (not shown) may be in fluid communication with a different portion of the mixing chamber. A plurality of valve seats may be positioned over top of each of those apertures to receive a valve that controls the flow of water through each aperture.

For example, a first valve seat 234 may be in fluid communication with a first aperture for providing hot water into detergent compartment 222. A second valve seat 236 may be in fluid communication with a second aperture for providing cold water into detergent compartment 222. A third valve seat 238 may be in fluid communication with a third aperture for providing cold water into softener compartment 224. A fourth valve seat 240 may be in fluid communication with a fourth aperture for providing cold water into mixing chamber 220 or directly into wash tub 121.

Water inlets may be placed in fluid communication with each of valve seats 234, 236, 238, 240. More specifically, a hot water inlet 244 may be connected to a hot water supply line (not shown) and a cold water inlet 246 may be connected to a cold water supply line (not shown). According to the illustrated embodiment, each water inlet 244, 246 may include a threaded male adapter configured for receiving a threaded female adapter from a conventional water supply line. However, any other suitable manner of fluidly connecting a water supply line and water inlets 244, 246 may be used. For example, each water supply line and water inlets 244, 246 may have copper fittings that may be sweated together to create a permanent connection.

Notably, hot water inlet 244 is in direct fluid communication with first valve seat 234. However, because washing machine appliance 100 uses cold water for multiple purposes, cold water inlet is in fluid communication with a cold water manifold 248. Cold water manifold 248 may be a cylindrical pipe that extends along the lateral direction from second valve seat 236 to fourth valve seat 240. In this manner, cold water manifold 248 places valve seats 236, 238, and 240 in fluid communication with cold water inlet 246.

Each of valve seats 234, 236, 238, 240 may be configured to receive a water valve 252 for controlling the flow of water through a corresponding aperture into mixing chamber 220. Water valve 252 may be, for example, a solenoid valve that is electrically connected to controller 108. However, any other suitable water valve may be used to control the flow of water. Controller 108 may selectively open and close water valves 252 to allow water to flow from hot water inlet 244 through first valve seat 234 and from cold water manifold 248 through one or more of second valve seat 236, third valve seat 238, and fourth valve seat 240.

Additive dispenser 200 may further include one or more nozzles (not shown) for directing wash fluid, such as water and/or a mixture of water and at least one fluid additive, e.g., detergent, fabric softener, and/or bleach into wash tub 121 from additive dispenser 200. For example, when second valve seat 236 is open, water may flow from cold water inlet 246 through cold water manifold 248 and second valve seat 236 into detergent compartment 222. Water may mix with detergent placed in detergent compartment 222 to create wash liquid to be dispensed into wash tub 121.

A nozzle (not shown) may be placed on the bottom of detergent compartment 222 or on the bottom of mixing chamber 220 to dispense the wash fluid into wash tub 121. According to the illustrated embodiment, additive dispenser 200 may include four nozzles associated with valves seats 234, 236, 238, 240, respectively. However, it will be understood that different nozzle configurations may be used in alternative exemplary embodiments. For example, nozzles may be positioned on a bottom of mixing chamber 220 near wash tub 121 or directly on wash tub 121, but could be positioned in other locations as well.

As discussed herein, in some situations, a user may wish to cause the flow of water separate from the flows associated with typical wash cycles. For example, a user may wish to obtain water for use when pretreating articles in a wash basin, as discussed herein. The user may thus utilize a suitable input selector 112 or other dedicated input to cause water to be flowed on-demand and independently of the typical wash cycles of the washing machine appliance 100.

As will be discussed below in more detail, the washing machine appliance 100 may include a pretreat cover that may advantageously be movable to and from a deployed position in which the pretreat cover can be utilized by a user for pretreating needs, such as scrubbing, treating, etc. When in the deployed position, the pretreat cover may further advantageously be sized to provide adequate surface area for pretreating needs while not completely blocking access to the washing basket 120 through the opening 105. The pretreat cover may further advantageously be movable to and from a stowed position in which the pretreat cover is out of the way and does not impede with the user's access to the wash basket 120 through the opening 105.

In some embodiments, the pretreat cover may be a board (FIGS. 5-11) that is rotatable between the deployed and stowed positions. In alternative embodiments, the pretreat cover may be flexible screen (FIGS. 12-20) that is movable between the deployed and stowed positions.

Referring now to FIGS. 5 through 11, a board 300 is depicted in accordance with embodiments of the present disclosure. The board 300 may be rotatably connected to the washing machine appliance 100. Further, the board 300 may be positioned between the wash basket 120 and an upper surface 142 of the top panel 140 along the vertical direction V. It should be appreciated that the board 300 may be formed from any suitable materials. For example, in some embodiments, the board 300 may be formed from a plastic. In some embodiments, the board 300 may be injection molded, and may thus be formed from an injection molded material, such as an injection molded plastic.

Figure 6:
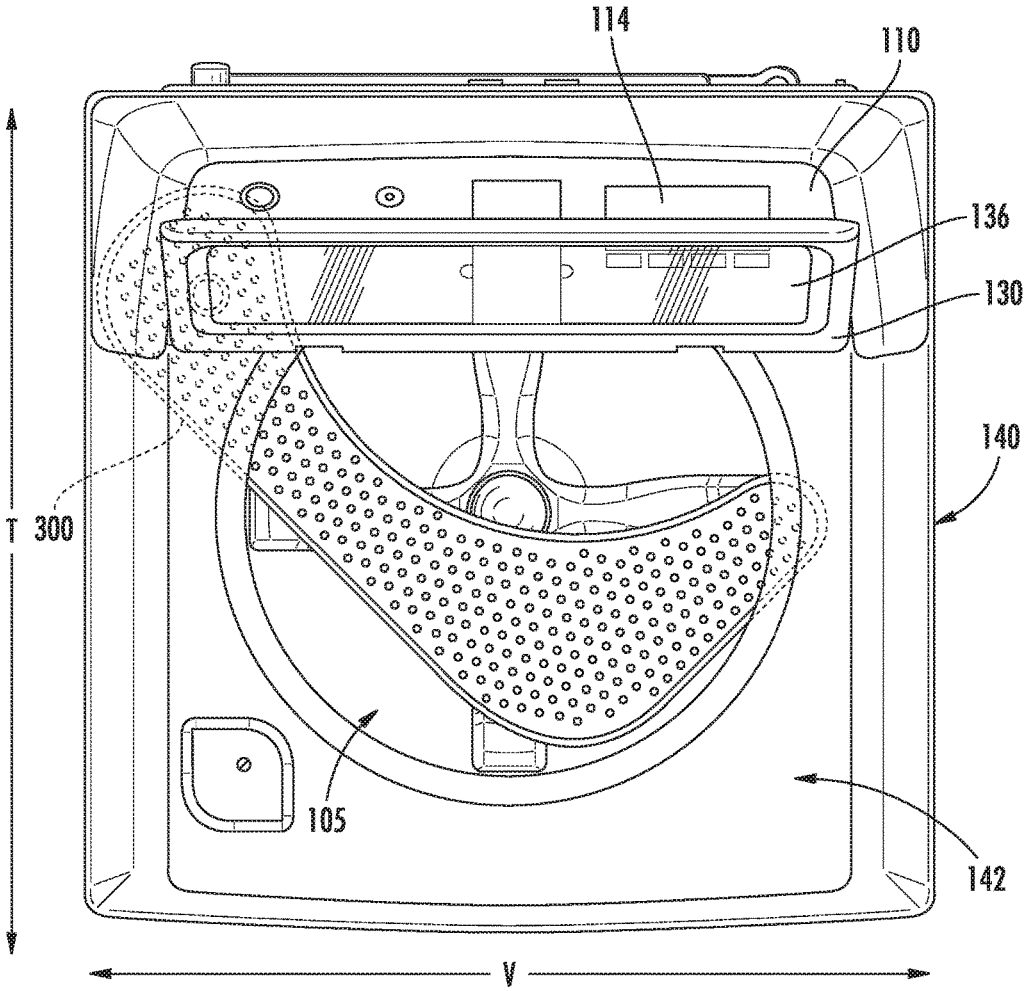
FIG. 6 provides a top-down view of a washing machine appliance with a pretreat cover in a deployed position in accordance with embodiments of the present disclosure.
Figure 7:
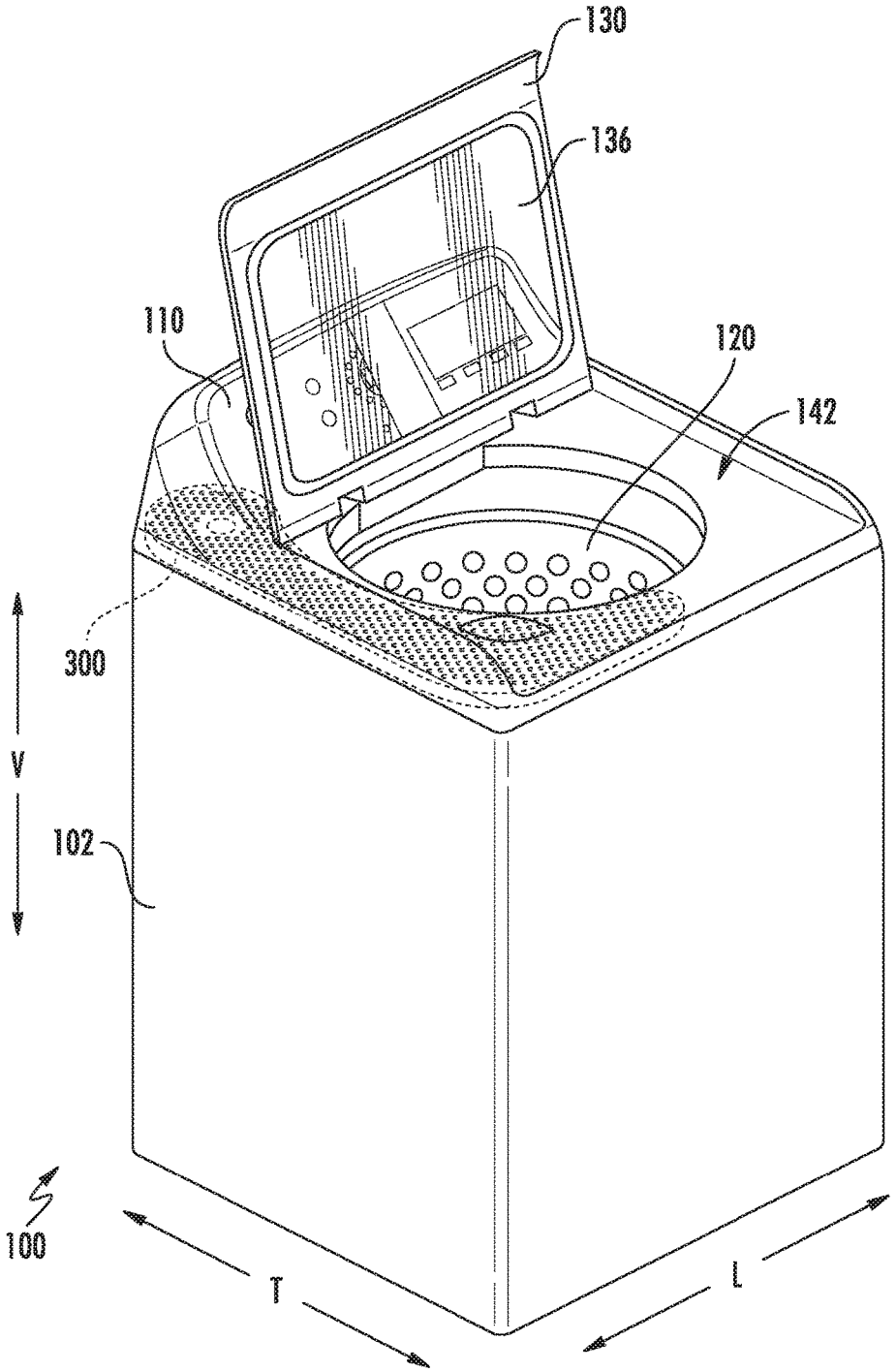
FIG. 7 provides a perspective view of a washing machine appliance with a pretreat cover in a stowed position in accordance with embodiments of the present disclosure.
Figure 8:
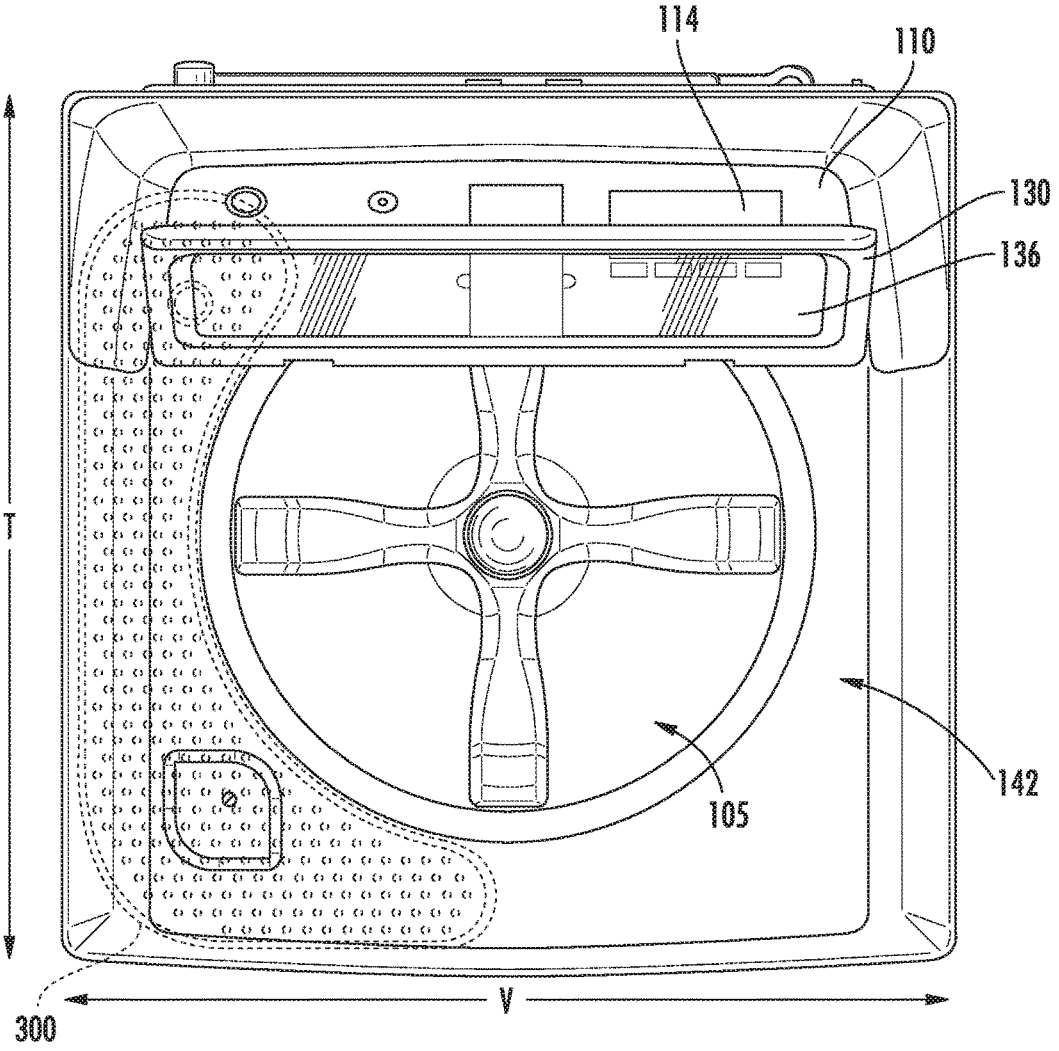
FIG. 8 provides a top-down view of a washing machine appliance with a pretreat cover in a stowed position in accordance with embodiments of the present disclosure.

The board 300 may be rotated to and from a deployed position (FIGS. 5 and 6) and a stowed position (FIGS. 7 and 8). In some embodiments, at least a portion of the board 300 may be at least partially disposed in the opening 105 when the board 300 is in the deployed position. In contrast, the board 300 may be spaced from the opening 105 when the board 300 is in the stowed position. In particular, the board 300 is spaced apart from the opening 105 along at least the lateral direction L. Further, the board 300 may be spaced apart from the opening 105 such that the board, in its entirety, is positioned within the top panel 140.

Figure 9:
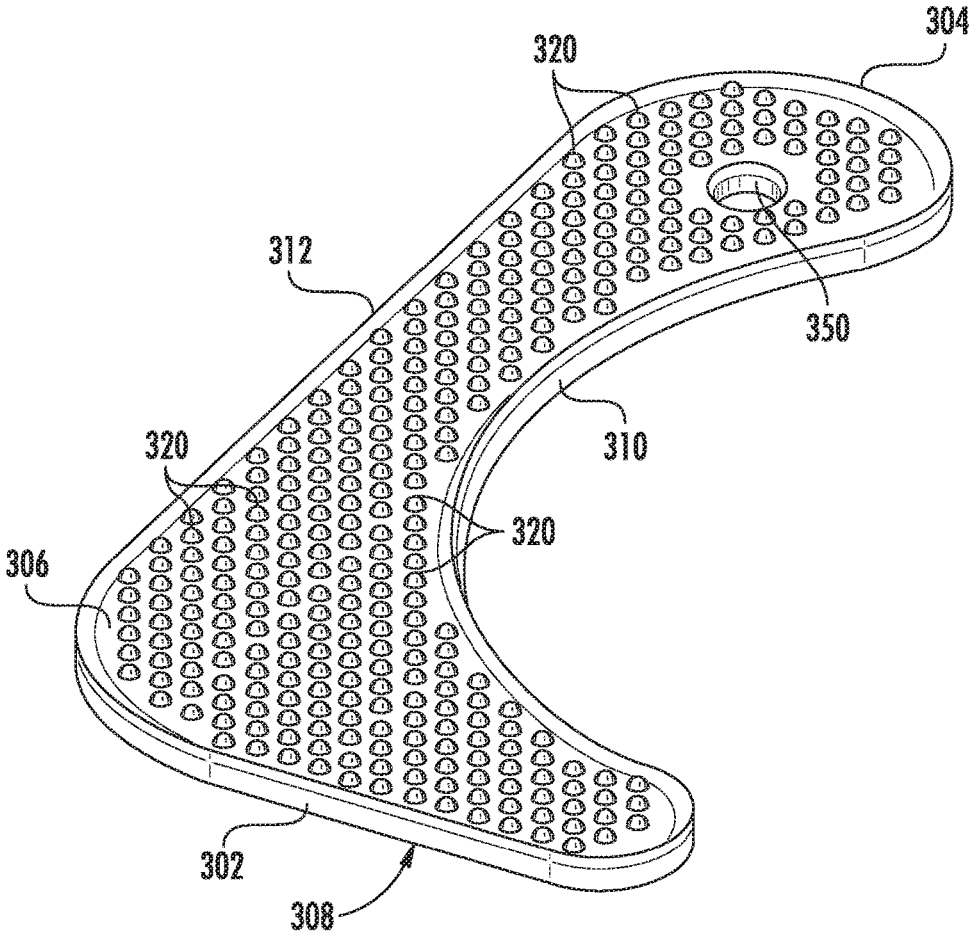
FIG. 9 provides a provides a top perspective view of a pretreat cover in accordance with embodiments of the present disclosure.
Figure 10:
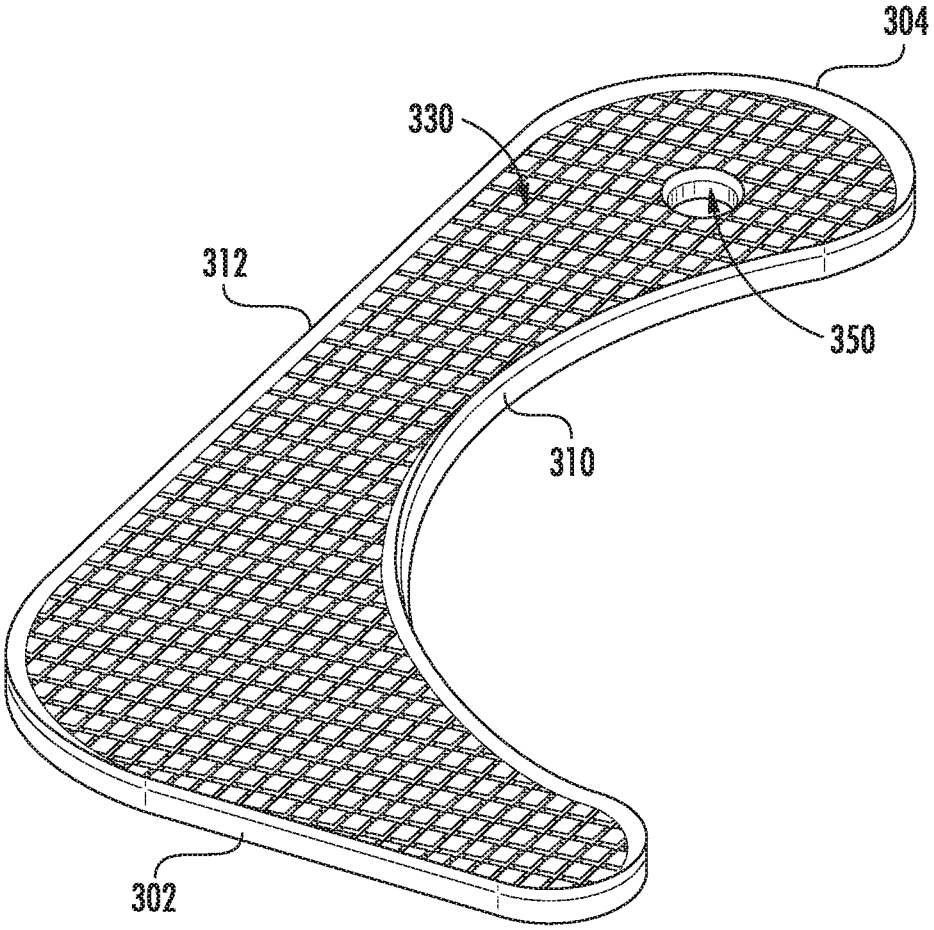
FIG. 10 provides a top perspective view of a pretreat cover in accordance with embodiments of the present disclosure.
Figure 11:
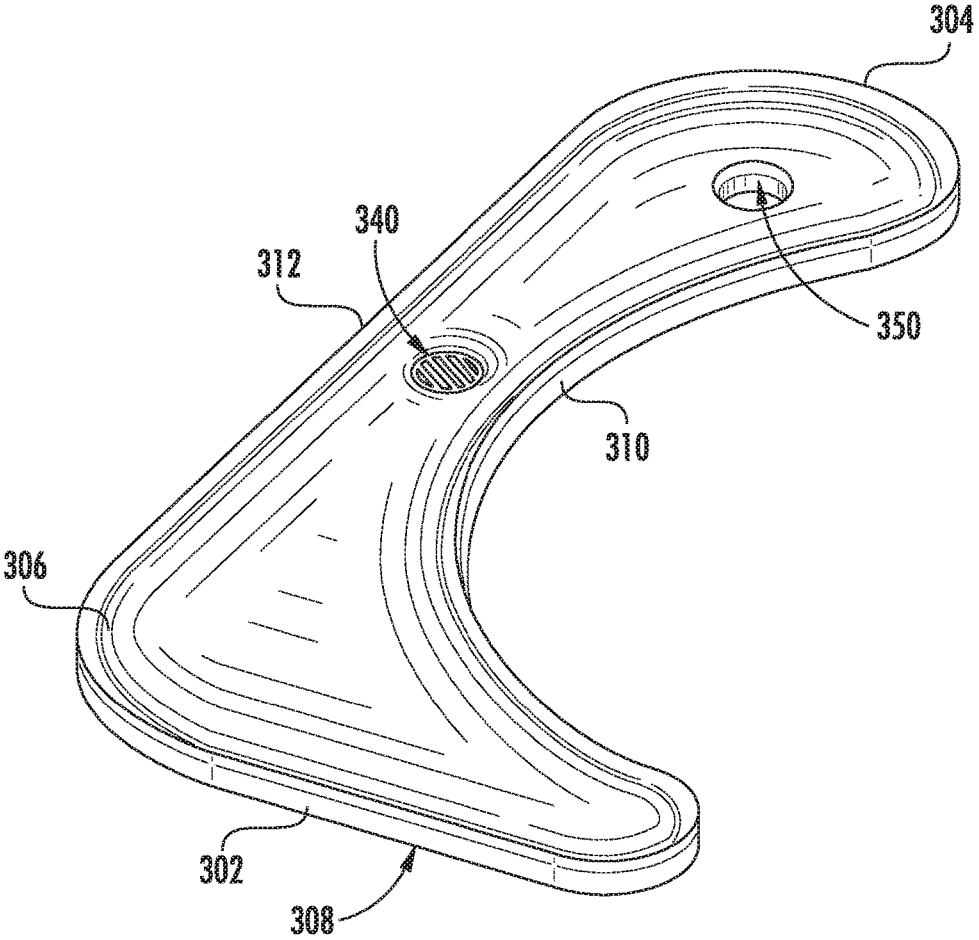
FIG. 11 provides a top perspective view of a pretreat cover in accordance with embodiments of the present disclosure.

Referring now to FIGS. 9-11, the board 300 may include a first end 302 and a second end 304. In particular, the first and second ends 302, 304 may be spaced apart from one another along the transverse direction T. The board 300 may also include a top surface 306 and a bottom surface 308. In particular, the top and bottom surfaces 306, 308 may be spaced apart from one another along the vertical direction V. In addition, the board 300 may include a first side 310 and a second side 312. When the board 300 is in the stowed position, the first and second sides 310, 312 may be spaced apart from one another along the lateral direction L. In contrast, the first and second sides 310, 312 may be spaced apart from one another along the transverse direction T when the board 300 is in the deployed position.

In operation, articles of clothing to be pretreated may be placed on the top surface 306 of the board 300. The top surface 306 may be a generally planar surface. In some embodiments, a plurality of protrusions 320 may extend from the top surface 306. The plurality of protrusions 320 may provide additional surfaces for scrubbing the articles of clothing. In alternative embodiments, however, the top surface 306 need not include the protrusions 320.

Additionally or alternatively, the top surface 306 may be sloped such that any water used during pretreating is directed into the wash basket 120. When the board 300 is in the stowed position, the top surface 306 may be sloped between the first and second sides 310, 312 along at least the lateral direction L. It should be appreciated, however, that the board 300 may employ any suitable method to drain water from the top surface 306 and into the wash basket 120.

In some embodiments, the board 300 may include a rigid screen 330 (FIG. 10) comprised of any suitable material (e.g., plastic). Further, the rigid screen 330 may be in fluid communication with the wash basket 120 when the board 300 is in the deployed position. Thus, water used during pretreating may drain through the rigid screen 330 and into the wash basket 120.

Figure 5:
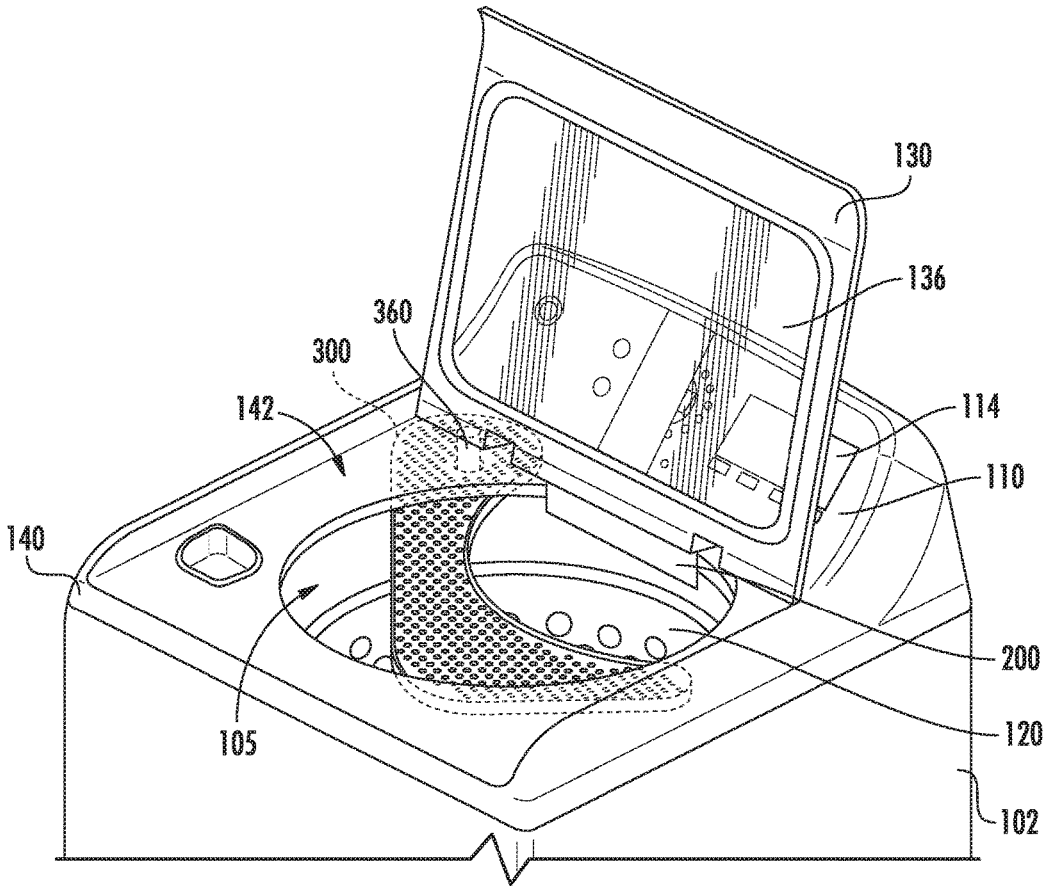
FIG. 5 provides a portion of a washing machine appliance with a pretreat cover in a deployed position in accordance with embodiments of the present disclosure.

In alternative embodiments, the board 300 may define a drain hole 340 (FIG. 11) that extends through the top and bottom surfaces 306, 308 along the vertical direction V. In some embodiments, the top surface 306 may be sloped to direct water towards the drain hole 340, which may be in fluid communication with the wash basket 121 when the board 300 is in the deployed position (FIGS. 5 and 6). Thus, water on the top surface 306 may drain into the wash basket 121 through the drain hole 340. It should be appreciated that the drain hole 340 may be located at any suitable location on the board 300.

The board 300 may define an aperture 350 extending therethrough along the vertical direction V. In particular, the aperture 350 may extend through both the top and bottom surfaces 306, 308 along the vertical direction V. In some embodiments, the board 300 may be rotatably connected to the top panel 140 via a support member 360 extending through the aperture 350 along the vertical direction V. In some embodiments, the support member 360 may be integrally formed with the top panel 140 as a single unitary component. Regardless, it should be appreciated that the board 300 may rotate relative to the support member 360. In particular, the board 300 may rotate between the deployed (FIGS. 5 and 6) and stowed (FIGS. 7 and 8) positions.

Figure 12:
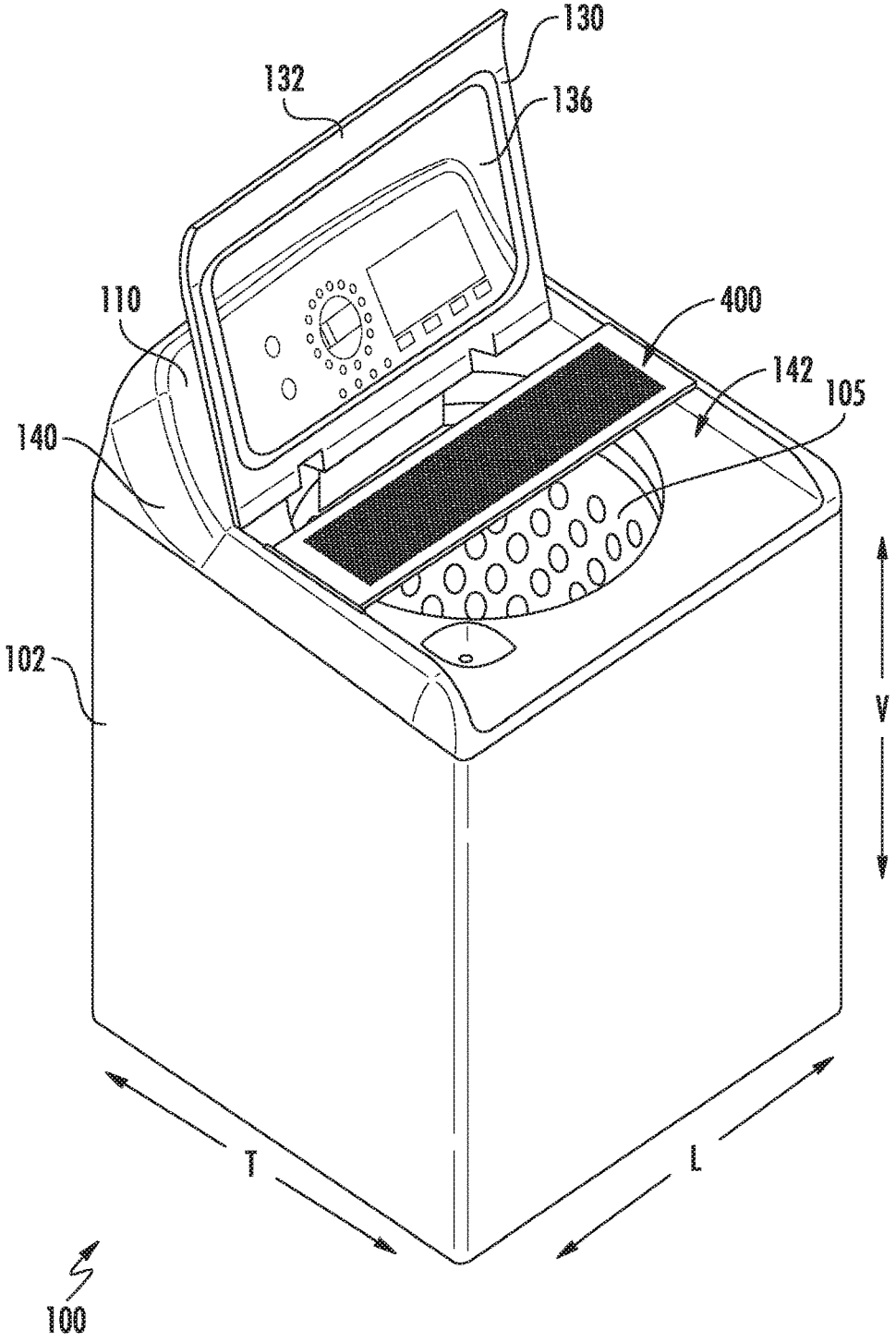
FIG. 12 provides a perspective view of a washing machine appliance having a pretreat cover in accordance with embodiments of the present disclosure.
Figure 13:
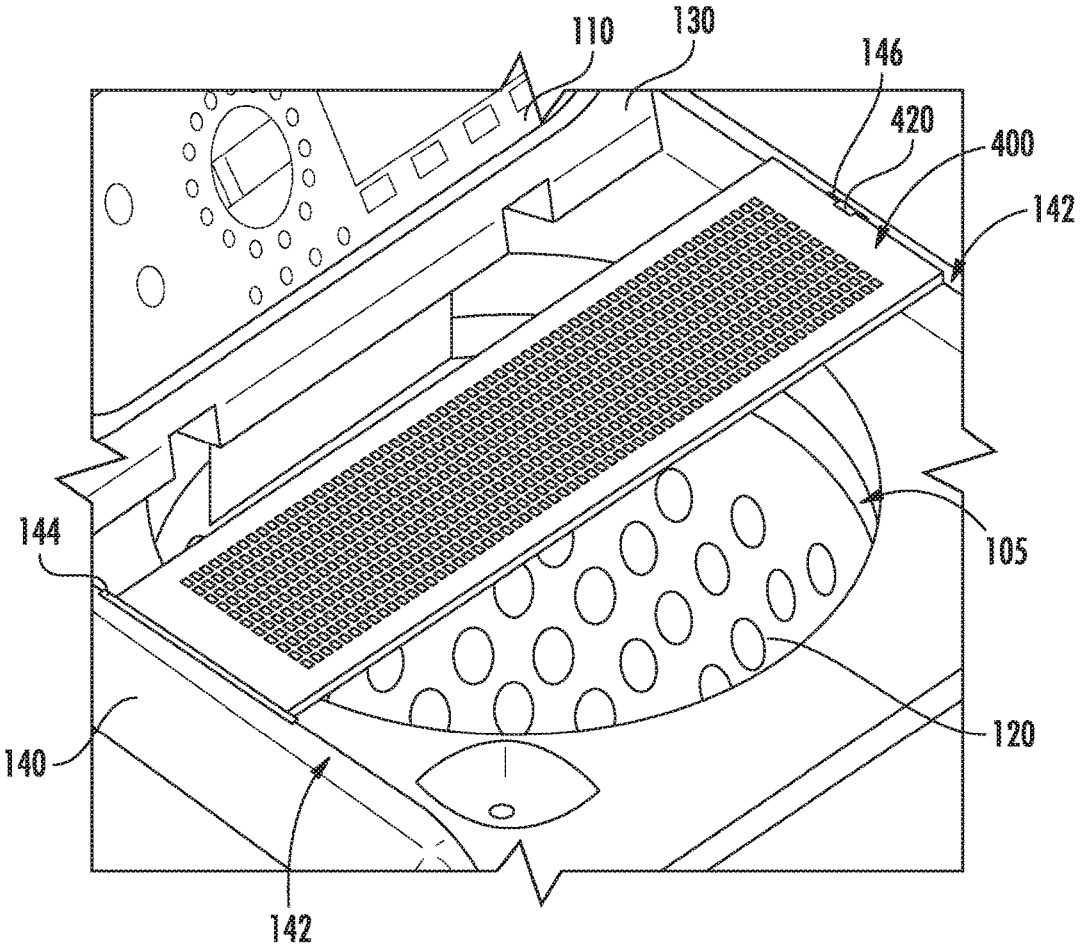
FIG. 13 provides a perspective view of the pretreat cover of FIG. 12 in a deployed position.
Figure 14:
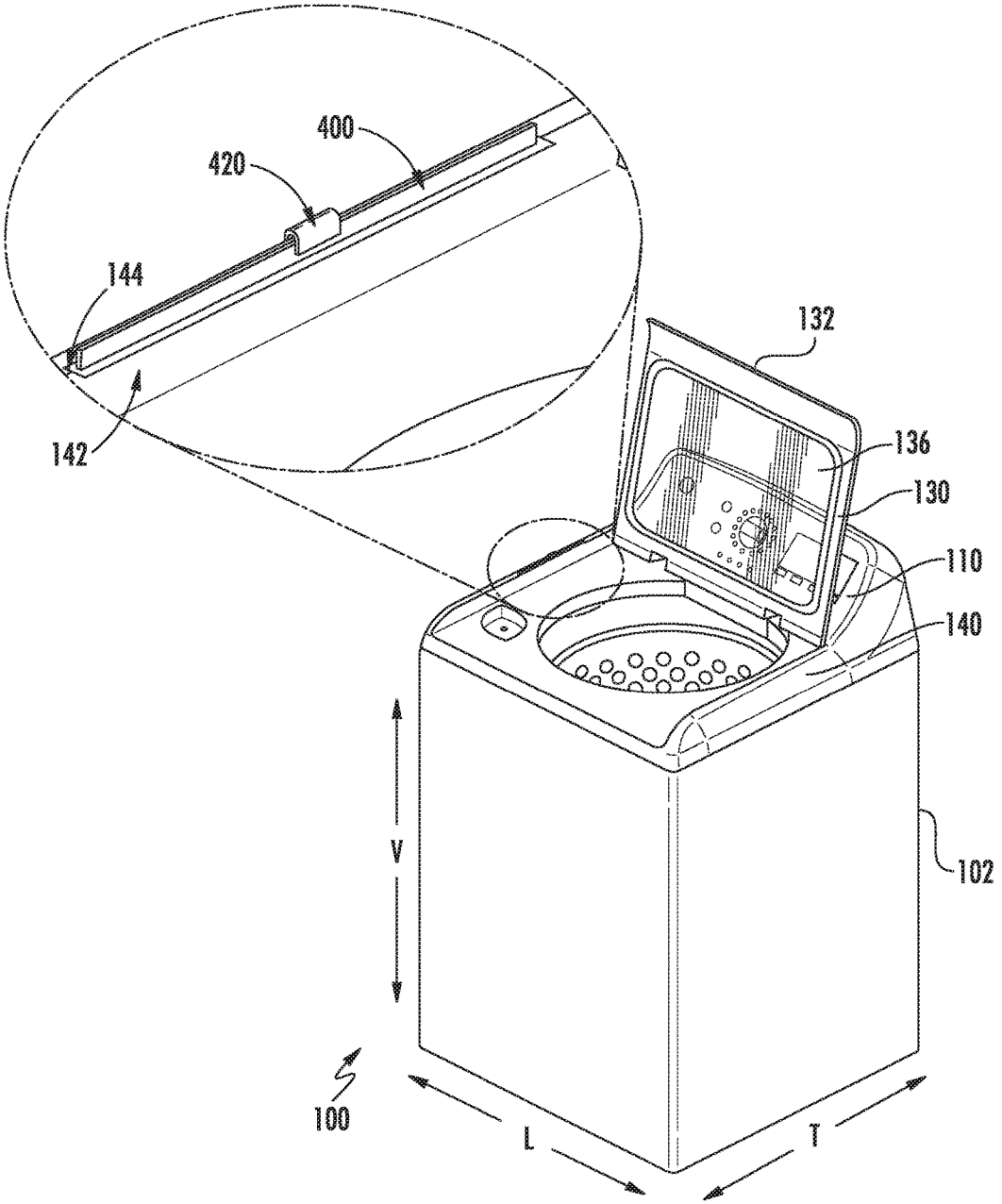
FIG. 14 provides a perspective view of the pretreat cover of FIG. 12 in a stowed position.
Figure 15:
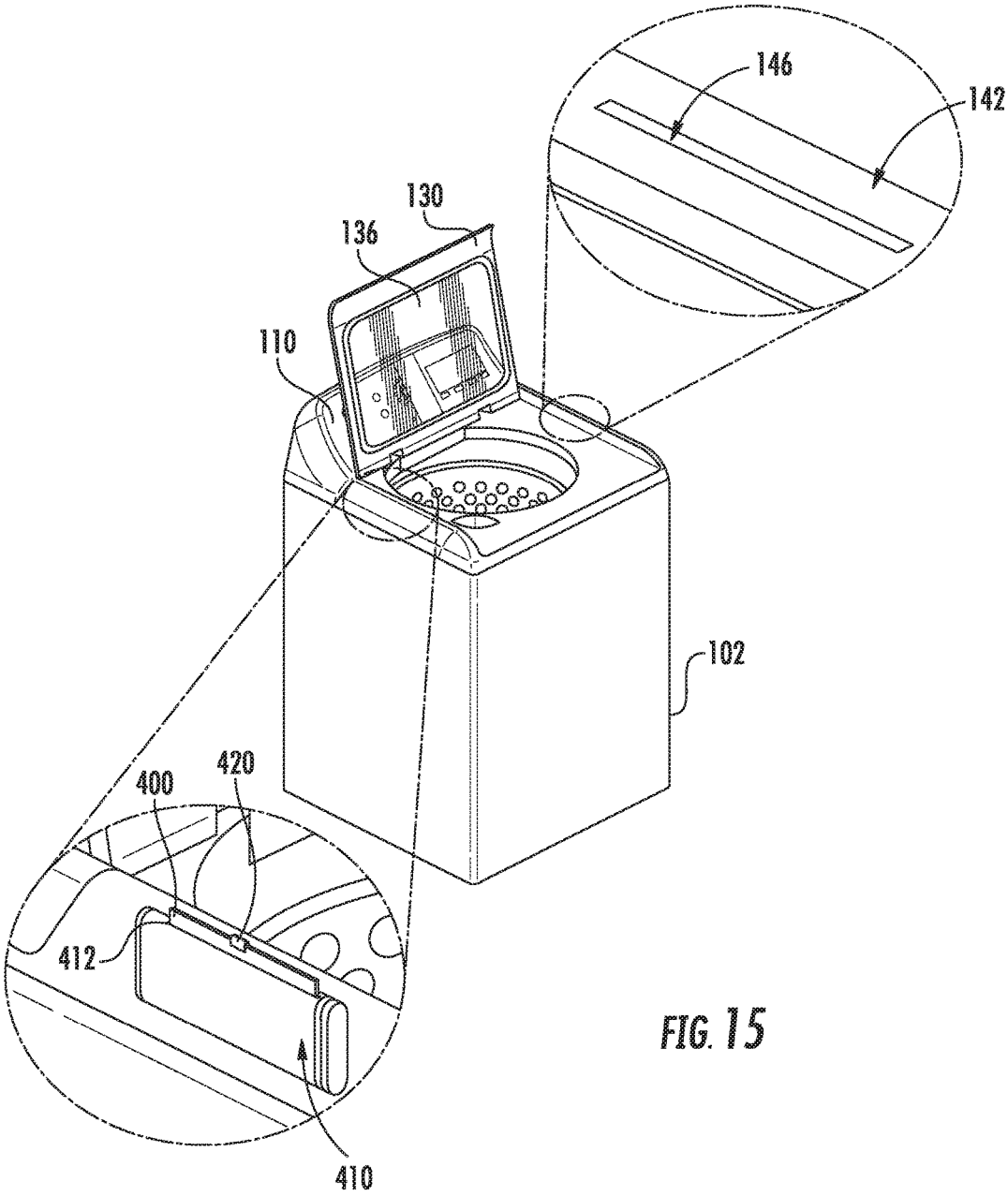
FIG. 15 provides perspective view of a housing of a pretreat cover in accordance with embodiments of the present disclosure.
Figure 16:
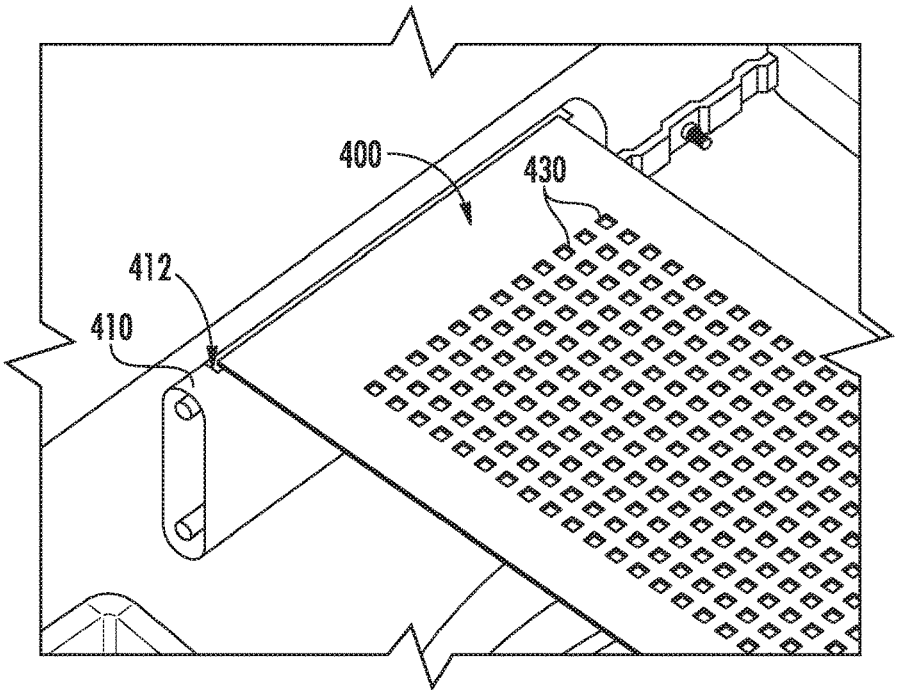
FIG. 16 provides a perspective view of a portion of the housing depicted in FIG. 15.
Figure 17:
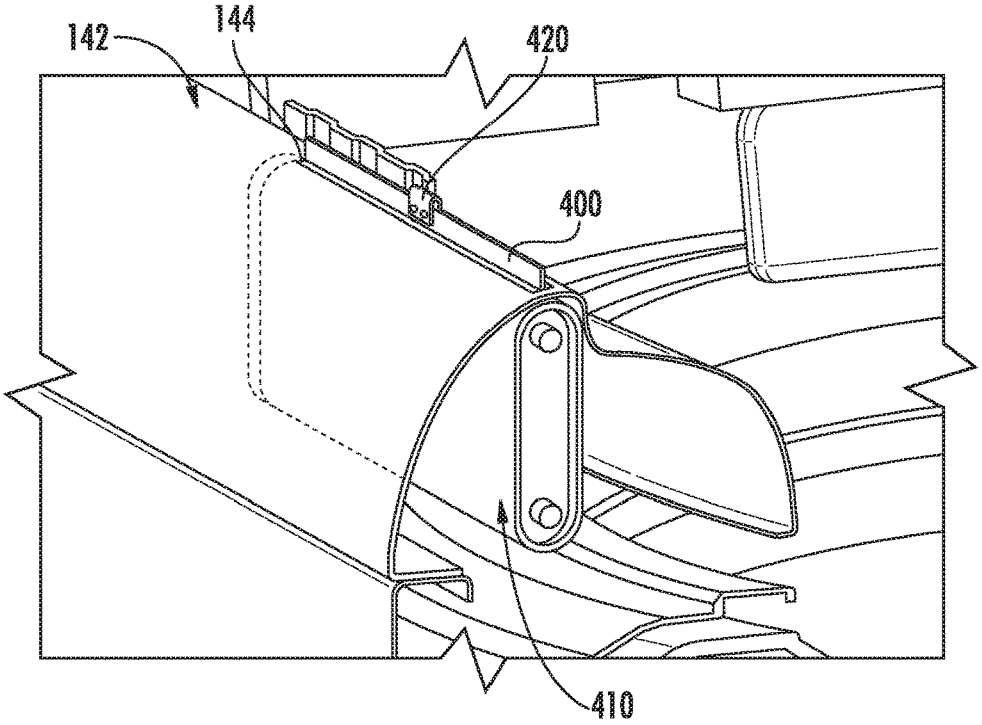
FIG. 17 provides a perspective view of a portion of the pretreat cover of FIG. 13
Figure 18:
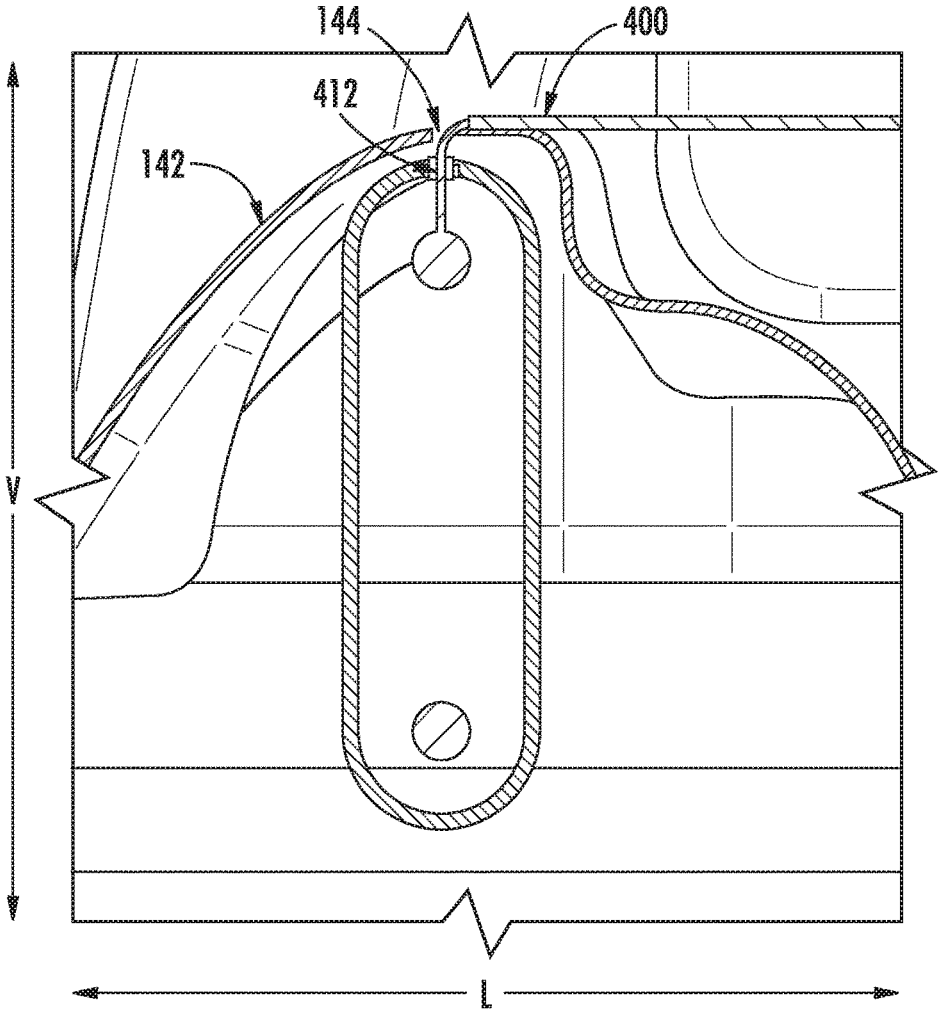
FIG. 18 provides a cross-sectional view of the pretreat cover of FIG. 17.
Figure 19:
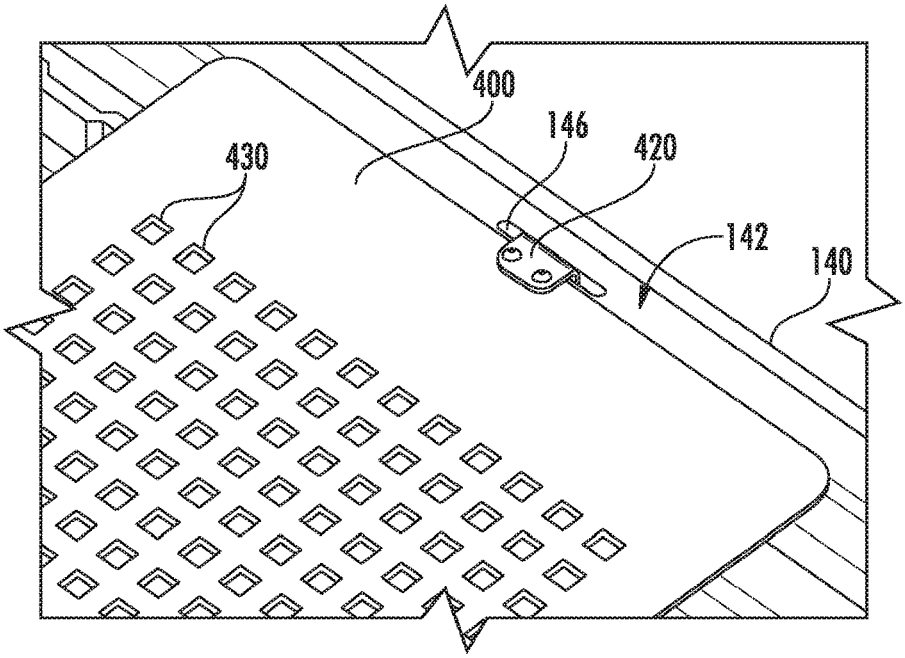
FIG. 19 provides a perspective view of another portion of the pretreat cover of FIG. 13.
Figure 20:
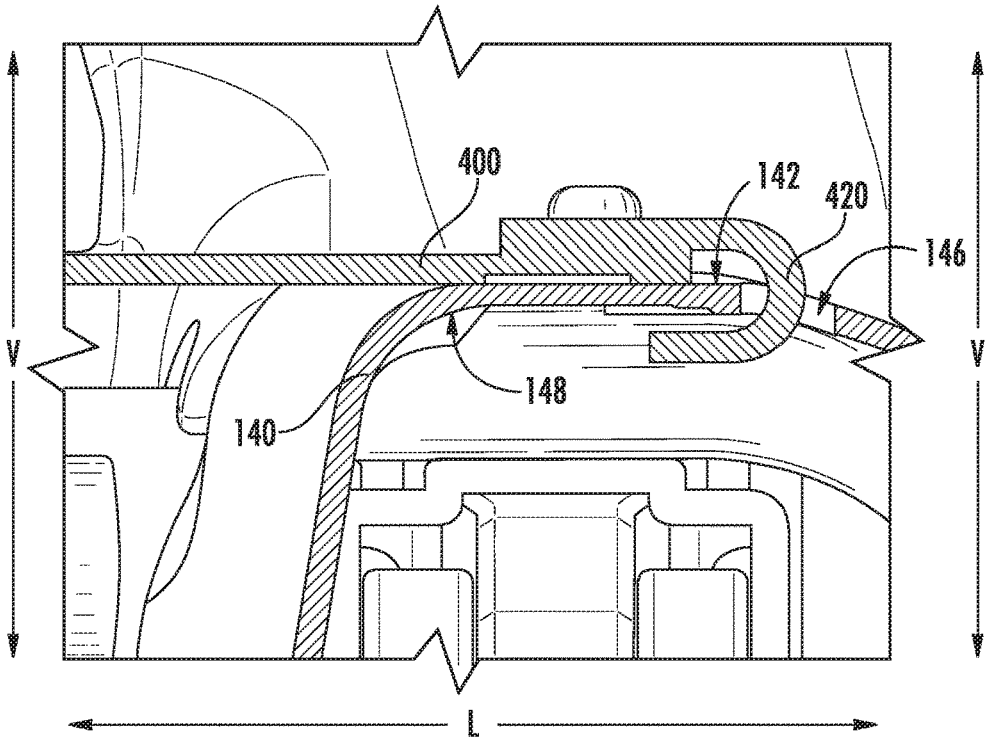
FIG. 20 provides a cross-sectional view of the pretreat cover of FIG. 18.

Referring now to FIGS. 12 through 19, the pretreat cover may, in some embodiments, be a flexible screen 400 that is movable between a deployed position (FIGS. 12 and 13) and a stowed position (FIG. 14). When in the deployed position, the flexible screen 400 may further advantageously be sized to provide adequate surface area for pretreating needs while not completely blocking access to the washing basket 120 through opening 105. The flexible screen 400 may further advantageously be retracted from the deployed position to the stowed position wherein the flexible screen 400 is out of the way and does not impede with the user's access to the wash basket 120 through the opening 105.

When in the stowed position, at least a portion of the flexible screen 400 may be spooled within a housing 410 that is positioned beneath an upper surface 142 of the top panel 140 along the vertical direction V. More specifically, the housing 410 may be positioned between the upper surface 142 and the wash basket 120 along the vertical direction V. The housing 410 may define an opening 412 (FIG. 16) through which the flexible screen 400 extends. Further, the top panel 140 may define a first aperture 144 and a second aperture 146 that is spaced apart from the first aperture 144 along the lateral direction L. In some embodiments, the opening 105 may be positioned between the first and second apertures 144, 146 along the lateral direction L. Further, the first aperture 144 may be aligned with the opening 412 along the vertical direction V. Accordingly, a portion of the flexible screen 400 may extend through the first aperture 144 when the flexible screen 400 is in the stowed position.

The flexible screen 400 may also include a latch 420. As shown, the latch 420 may be attached to the flexible screen 400 via one or more mechanical fasteners 422. It should be appreciated, however, that the latch 420 may be attached to the flexible screen 400 via any suitable method. Alternatively, the latch 420 may be integrally formed with the flexible screen 400 as a singular component.

As the flexible screen 400 moves from the stowed position (FIG. 14) to the deployed position (FIGS. 12 and 13), the flexible screen 400 moves towards the second aperture 146 along the lateral direction L. More specifically, the flexible screen 400 unspools within the housing 410 during movement from the stowed position (FIG. 14) to the deployed position (FIGS. 12 and 13). When the flexible screen 400 is in the deployed position, the latch 420, or at least a portion thereof, extends through the second opening 146. In some embodiments, the latch 420 contacts the top panel 140 to retain the flexible screen 400 in the deployed position. More specifically, the latch 420 may contact an underside 148 of the top panel 140. It should be appreciated that the underside 148 of the top panel 140 may be spaced apart from the upper surface 142 along the vertical direction V.

The flexible screen 400 may define a plurality of apertures 430. Further, each aperture of the plurality of apertures 430 may be in fluid communication with the wash basket 120 when the flexible screen 400 is in the deployed position. Accordingly, water used to pretreat articles of clothing laid on the flexible screen 400 may drain into the wash basket 120 through the plurality of apertures 430.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical, a lateral, and a transverse direction, the washing machine appliance comprising:

a cabinet comprising a top panel, the top panel defining an opening;

a tub positioned within the cabinet;

a wash basket rotatably mounted within the tub, the wash basket defining a wash chamber for receiving articles for washing;

a door rotatably mounted to the top panel to permit selective access to the opening, the door rotatable between an open position and a closed position; and a pretreat cover rotatable between a stowed position and a deployed position, wherein in the stowed position the pretreat cover is spaced apart from the opening, and wherein in the deployed position at least a portion of the pretreat cover is at least partially disposed in the opening.

2. A washing machine appliance defining a vertical, a lateral, and a transverse direction, the washing machine appliance comprising:

a cabinet comprising a top panel, the top panel having an opening;

a tub positioned within the cabinet;

a wash basket rotatably mounted within the tub, the wash basket defining a wash chamber for receiving articles for washing;

a door rotatably mounted to the top panel to permit selective access to the opening, the door rotatable between an open position and a closed position; and a flexible screen that is movable between a stowed position and a deployed position; and a housing separate from the top panel, the housing positioned between the wash basket and an upper surface of the top panel along the vertical direction, the housing configured to accommodate the flexible screen, wherein in the stowed position the flexible screen is spaced apart from the opening, and wherein in the deployed position at least a portion of the flexible screen is at least partially disposed in the opening.

3. The washing machine appliance of claim 2, wherein at least a portion of the flexible screen is spooled within the housing when the flexible screen is in the stowed position.

4. The washing machine appliance of claim 3, wherein the top panel defines a first aperture and a second aperture, the first aperture and the second aperture spaced apart from one another along the lateral direction, and wherein the opening is positioned between the first and second apertures along the lateral direction.

5. The washing machine appliance of claim 4, wherein the housing defines an opening that is aligned with the first aperture along the vertical direction, and wherein the flexible screen extends through both the first aperture and the opening defined by the housing.

6. The washing machine appliance of claim 5, wherein the flexible screen includes a latch.

7. The washing machine appliance of claim 6, wherein when the flexible screen is in the deployed position, the latch extends through the second aperture and contacts a bottom surface of the top panel.

* * * * *